United States Patent [19]

Gibilisco

[11] 4,433,789

[45] Feb. 28, 1984

[54] CONVERTIBLE CHILD RESISTANT CLOSURE

[75] Inventor: Kenneth J. Gibilisco, Warminster, Pa.

[73] Assignee: Merck & Co., Inc., Rahway, N.J.

[21] Appl. No.: 451,502

[22] Filed: Dec. 20, 1982

[51] Int. Cl.[3] ..... B65D 55/02

[52] U.S. Cl. ..... 215/220; 215/251

[58] Field of Search ..... 215/216, 219, 220, 251

[56] References Cited

U.S. PATENT DOCUMENTS 3,837,518 9/1974 Gach ..... 215/219

3,944,102 3/1976 Grau ..... 215/251

*Primary Examiner*—George T. Hall

*Attorney, Agent, or Firm*—Thomas E. Arther; Mario A. Monaco

[57] ABSTRACT

This disclosure relates to an improved, new convertible child-resistant 2-piece closure comprising an inner cap comprising a circular top panel and integrally attached depending skirt having internal threads for engagement with corresponding external threads surrounding a conventionally threaded container exit neck. A plurality of spaced apart depressions extend downwardly from the top panel of said inner cap. Projecting upwardly and arranged in the same concentric circle of the top panel of said inner cap are a plurality of ratchet lugs, shaped in ramp form. An outer cap is also formed of a circular top panel and integrally attached depending skirt. Integrally formed on the inner side of the outer cap top panel are a plurality of downwardly extending drive lugs positioned in a circle of equal radius as the depression and ratchet lugs on the inner cap top panel.

A particular novel feature of the present invention is the provision of a means to convert a child resistant closure into a non-child-resistant closure or to render the closure permanently child resistant. This is accomplished by provision of a means for completely removing the outer cap member for example by providing the depending skirt with an inner vertical groove and an attached removable tab to facilitate splitting of the outer cap and easy removal. Another novel feature of the present invention is the provision of a means providing visible evidence of previous opening or use of the closure. This is accomplished by means of a tear strip attached to the bottom edge of the inner or outer cap member and positioned directly beneath the outer cap member skirt.

8 Claims, 7 Drawing Figures

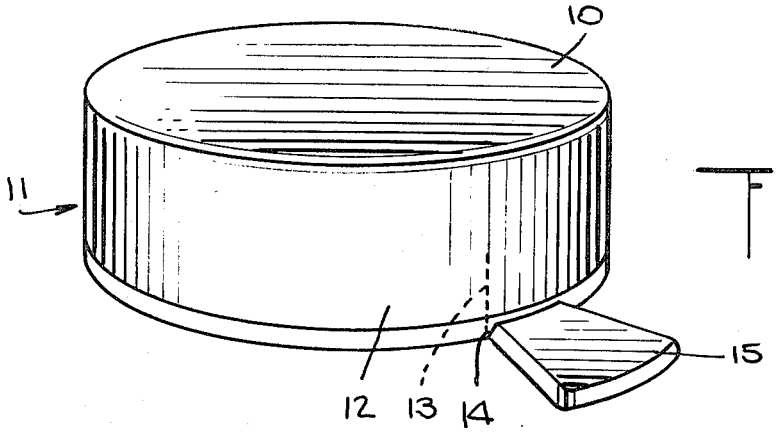
Fig. 1.
Fig. 7.
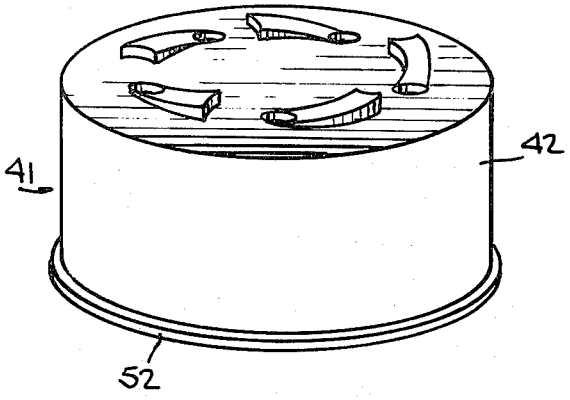
Fig. 6.
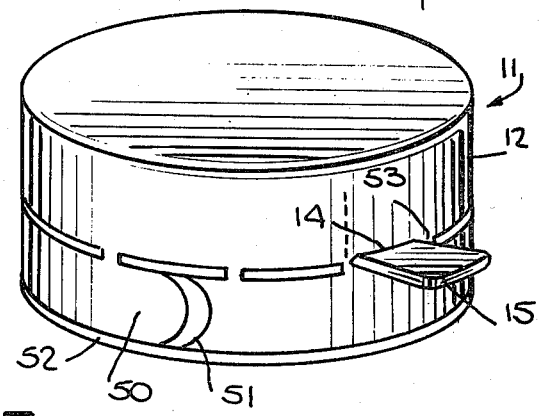
Fig. 3.
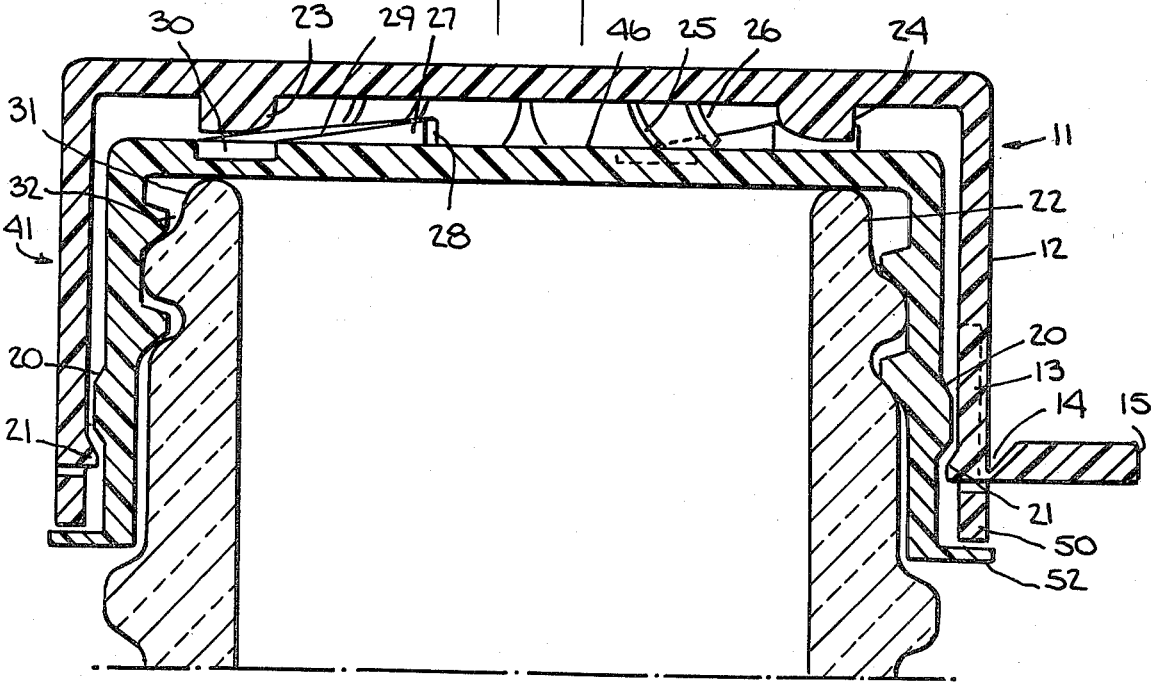

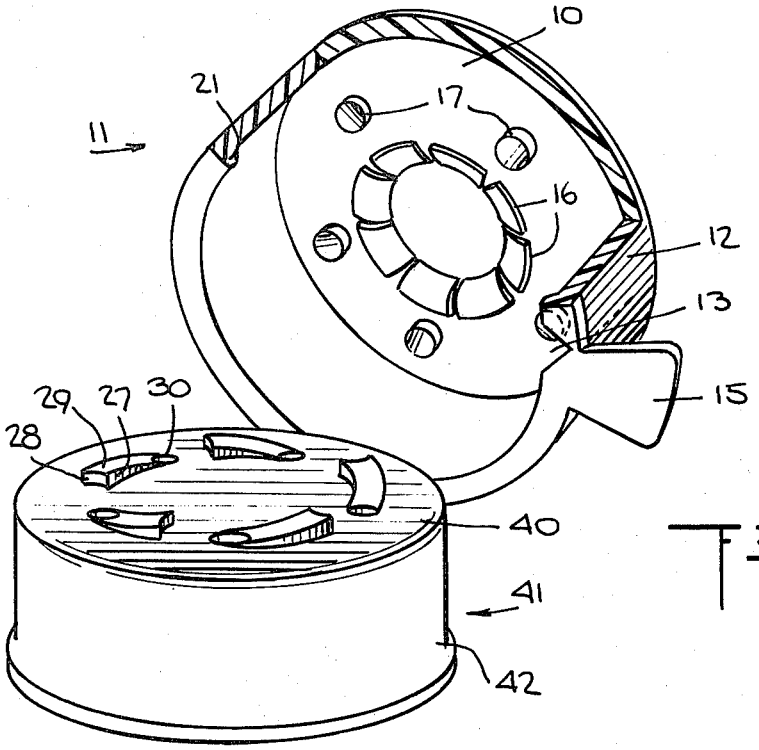
Fig. 2.
Fig. 4.
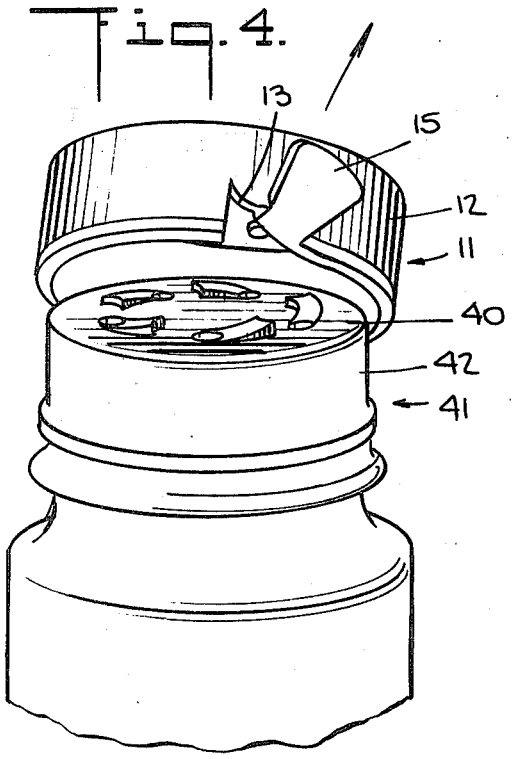
Fig. 5.
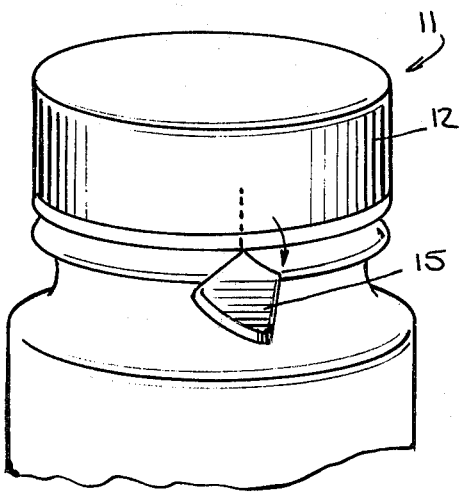

CONVERTIBLE CHILD RESISTANT CLOSURE

BACKGROUND OF THE INVENTION

This invention generally relates to child-resistant safety closures having an improved type of removal drive. More particularly this invention relates to a child-resistant closure of the two piece type which may be readily converted to a non-child-resistant closure by the individual dispersing the container to the user. An additional safety feature of the present invention is an embodiment including an extension of the depending skirt portion of the outer or inner cap in the form of a tear strip which must be torn away before the closure can be removed, providing visual evidence of tampering or previous opening of the container.

The disclosure of the present invention is related in part to the disclosure of U.S. Pat. No. 3,857,505 and to other commercially available 2-piece child-resistant safety closures. However, the present closure is believed to provide a more positive removal mechanism and also to provide a feature useful in converting the child-resistant closure to a non-child-resistant closure as well as an additional feature of construction providing evidence of tampering or previous opening of the container after manufacturing and initial filling.

Child-resistant closures are generally somewhat difficult to remove and thus present a problem to a patient with limited finger mobility. Previous closures providing convertible closures retain their convertible feature throughout the life of the container, allowing the user the option of converting the closure each time the container is used. The present invention provides a convertible closure which can be permanently converted to a child-resistant or a non-child-resistant closure at the time of initial use. This prevents the potential danger of a user inadvertently misusing such a closure in an area where children may have potential access to the container.

SUMMARY OF THE INVENTION

The invention is a convertible, child-resistant closure for containers having an externally threaded neck portion. The two piece closure comprises the following components (1) an inner cap member is formed having a circular top panel integrally formed with a depending skirt portion said skirt optionally fitted at the bottom with an integrally formed outwardly extending flange and having internal threads for engagement with the corresponding threads of a conventionally threaded container neck. A plurality of spaced apart depressions extend downwardly from the top surface of the inner cap arranged in a concentric circle of smaller radius than the top panel of said inner cap. Projecting upwardly and arranged in the same concentric circle of the top panel of said inner cap are a plurality of ratchet lugs shaped in ramp form. (2) An outer cap encloses said inner cap, said outer cap formed with a circular top panel and an integral downwardly depending skirt portion. Integrally formed on the underside of the outer cap top panel are a plurality of downwardly extending drive lugs positioned in a circle of equal radius as the depressions and ratchet lugs on the inner cap top panel. These depressions and drive lugs are engaged when outer and inner caps are in axial position one, that is with outer cap pressed down onto inner cap which will provide a biasing force to drive the inner cap in a closure loosening direction. Also formed on the under surface of the outer cap top panel are a plurality of inclined leaf spring members which provide a biasing force separating the inner and outer caps in a second axial position. In this position, the drive lugs' outer cap circle over the inclined ramp shaped ratchet lugs freely in the untightening direction but engage the vertical side of the ratchet lugs to drive the inner and outer caps as a unit in the tightening direction. (3) The outer cap is also provided with means for converting the closure into a non-child-resistant closure by removing the outer cap member or means to permanently retain its child-resistant nature. Thus, in one embodiment the depending skirt is provided with an inner vertical weakening groove which allows the supplier to split said skirt and remove the outer cap from engagement with said inner cap, thus leaving only the inner cap as a non-child-resistant closure. The removal of the outer cap is assisted by provision of a tab means integrally attached to the outer bottom edge of the depending skirt. This tab means may be used to assist in removing said outer cap from the closure or may alternately be broken off along its point of attachment to the dependent skirt. For this purpose the tab is scored along one side of the attachment to allow easy breaking and removal of said tab and provide a permanent child-resistant closure. (4) A further feature of the present invention is a means for providing assurance to the user that the package has not been opened. This feature is provided as an extension of the outer or inner cap member skirt in the form of a removable tear strip prevents use of the closure until the skirt extension tear strip is removed.

BRIEF DESCRIPTION OF THE DRAWINGS

FIG. 1 is a side-perspective view of the outer cap with attached scored tab.

FIG. 2 is a perspective view of the cooperating surfaces of inner and outer members with a portion of the outer member cut away to show details of construction.

FIG. 3 is a side elevation section view of the assembled structure in engagement on a container.

FIG. 4 is a perspective view of the structure with top cap being removed leaving structure with inner cap only as non-child-resistant closure.

FIG. 5 is a perspective view of the structure assembled with tab removed providing a permanent child-resistant closure.

FIG. 6 is a perspective view of the combined closure showing an extension skirt below the outer cap member.

FIG. 7 is a perspective view of the outer part of the inner cap showing the flange attached but no other features.

DETAILED DESCRIPTION OF THE DRAWINGS

The closure of the present invention is made up to 2 components: an inner cap member 41 shown in FIGS. 2 and 4; and an outer cap member 11 shown in FIGS. 1, 2, 4 and 5. With reference to FIG. 1, the outer cap member is formed with a circular top panel 10 integrally molded with a depending skirt portion 12. Included in the outer cap is a weakening vertical groove 13 in depending skirt 12 and a tab 15 integrally molded to the bottom edge of dependent skirt 12 positioned adjacent vertical groove 13. As seen in FIG. 2, molded into the underside of top panel 10 are a plurality of angled leaf spring members 16. Eight members are shown but from 2–8 will suffice. The position of the leaf springs on the underside is not critical provided that there is no positional interference with the drive lugs 17. A plurality of drive lugs 17 are also molded into the underside of top panel 10 located on a circle intermediate between the center and the circumference of the top panel. Five such drive lugs are illustrated but from 1 to 6 are satisfactory. Multiple drive lugs provide ease of engagement with corresponding socket or depression and swift operation of the device. A retention bead 21 is molded into the interior wall of the depending skirt 16 near the lower portion thereof. The outer cap 11 may be manufactured of material such as polyethylene and propylene to provide necessary resilience for the leaf spring members 16.

With respect to FIG. 2 and 4 the inner cap member 41 is also an integral unit formed of a circular top panel 40 and a depending skirt 42. As shown in FIG. 3 the interior of the depending skirt 42 may be provided with threads 32 for engagement with a conventionally threaded exit neck 31 of a container. With further reference to FIGS. 2 and 4, projecting upwardly and arranged in a circle satisfactory for cooperative engagement with drive lugs 17 of outer cap 11 are a plurality of ramp-shaped ratchet lugs of vertical face 28, triangular side panel 27, inclined ramp 29 sloping to terminate in depression or lug socket 30.

The additional feature of the present invention is illustrated in FIGS. 2 and 4 which provides the versatility of convertibility of the closure supplied with the container into either a child-resistant closure or a non-child-resistant closure at the time of transfer to the ultimate user. The outer cap member 11 is formed with a vertical notch or groove 13 extending vertically on the interior surface of depending skirt 12 providing a tear line facilitating removal of the outer cap by use of the tab 15 molded to the exterior lower edge of the depending skirt 12 and immediately adjacent thereto. Removal of the outer cap 11 by tearing along the vertical groove 13 allows use of the container as a single cap non-child-resistant container.

The closure also provides the additional safety feature of converting the closure into a permanent child-resistant closure at the time of supplying the item to the ultimate user. Thus, the tab 15 attached to the lower outer edge of depending skirt is provided with a groove 14 as illustrated in FIGS. 1 and 3 at the junction of the upper surface of tab 15 and depending skirt 13. This groove allows the supplier to remove the tap 15 by pressing firmly down on the tab 15 thus breaking it cleanly away as illustrated in FIG. 5 and providing a permanent 2-piece child-resistant closure which is not convertible by ordinary manual means to a non-child resistant closure.

With reference to FIG. 3 the closure is shown assembled together in axial position one wherein leaf springs 25, 26 are angled from the horizontal to maintain the drive lugs 23 and 24 above the top surface of the inner cap member but at a level such that said drive lugs will engage the vertical surface 28 of the ratchet lugs thus providing a rotational bias to said inner cap when twisted in a tightening direction but allowing said drive lugs to slide readily over the slanted ramp surface 29 when turned in a loosening direction without imparting any rotational loosening force to said inner cap member. Pressing the outer cap 11 toward the inner cap while rotating seats drive lug 23 in socket 30 units the inner and outer caps in axial position two and causes the inner cap to rotate in unison with said outer cap in an unloosening direction.

Referring to FIGS. 6 and 7 and FIG. 3, an additional safety feature of the present invention allows a user to determine whether the closure has been previously operated or opened. In FIG. 6 the outer cap member 11 or inner cap member 41 is formed with a bottom edge skirt extension 50 as a tear strip removable by pulling tab 51 integrally attached to said skirt extension 50. Referring to FIG. 6 the inner cap member 41 is integrally formed at the lower edge of the depending skirt 42 with an outwardly extending flange member 52. Before use, the outer member and inner members are assembled with said tearstrip 50 seated on said flange member, preventing operation of the device until the tear strip is torn away thus providing visual evidence of prior use of the device.

In an alternate embodiment of the structures shown in FIGS. 6 and 7, the outer skirt 12 is completely separate from skirt extension 50 but seated thereon. In this alternate embodiment the skirt extension 50 is integrally formed as an offset extension of inner skirt 42. Thus, the skirt extension 50 is integrally attached to the bottom edge of inner skirt 42 by a plurality of breakable ribs extending radially from the bottom edge of inner skirt 42 to the top edge of skirt extension 50. In this embodiment the inner skirt has no bottom flange and extends downwardly to the top edge of skirt extension tear strip 50. Also in this embodiment, tear strip extension skirt 50 must be removed prior to use since the outer skirt 12 is seated on said tear strip which is integrally attached to the bottom edge of the inner skirt 42, preventing operation of the device until the tear strip is torn away, providing visual evidence of prior use.

Although the improvements described herein of the removable outer cap and the tear strip skirt extension have been described with respect to the particular 2-piece child-resistant structure disclosed in the previous application, it is evident to anyone skilled in the art that these particular features could be applied to any of the conventional 2-piece child-resistant closures employing an inner cap member and an outer cap member in which the child-resistant feature would be eliminated by removing the outer cap member.

What is claimed is:

1. In an improved child resistant two-piece closure for containers having inner and outer cap members, said inner and outer cap members allowing relative rotatory and axial movement between said inner and outer members and having flexible means and ratchet drive means attached to the inner surface of said outer cap member and/or the outer surface of said inner cap member to maintain said members in axial position two to allow rotation of said outer cap without imparting motion to said inner cap in the loosening direction but causing engagement of the ratchet drive means in the tightening direction and means for locking said inner and outer cap members in axial position one, thereby permitting removal of said closure by rotation in the loosening direction, the improvement which comprises provision of a means for removing said outer cap member without removing said inner cap member thereby converting said two piece child resistant closure into a one piece non-child resistant closure.

2. In an improved child resistant two-piece closure for containers having inner and outer cap members, said inner and outer cap members allowing relative rotatory and axial movement between said inner and outer members and having flexible means and ratchet drive means attached to the inner surface of said outer cap member and/or the outer surface of said inner cap member to maintain said members in axial position two to allow rotation of said outer cap without imparting motion to said inner cap in the loosening direction but causing engagement of the ratchet drive means in the tightening direction and means for locking said inner and outer cap members in axial position one, thereby permitting removal of said closure by rotation in the loosening direction, the improvement which comprises of a tear strip cap skirt extension integrally formed on the bottom edge of the outer cap member skirt or the inner cap member skirt, said outer cap member skirt being located directly above said tear strip cap skirt extension, thereby preventing operation of said closure without removing said tear strip skirt extension.

3. An improved convertible child-resistant closure for containers having an exteriorly threaded neck portion comprising in combination an inner cap member having a top panel integrally formed with a depending skirt portion, said depending skirt portion having threads formed on the interior surface thereof for engagement with said threaded container neck, a plurality of spaced apart depressions or sockets and alternating ramp-like ratchet lugs formed in a circle intermediate between the center and the circumference of the top of said inner cap circular top panel, and an outer cap member having a top panel integrally formed with a depending skirt portion said depending skirt loosely enclosing said depending skirt portion of said inner cap member allowing relative rotary and axial movement between said inner and outer members, a plurality of downwardly directed drive lugs integrally formed on the inner surface of the top panel of said outer member, said drive lugs being seated in said depression or sockets of said inner cap member in axial position one and being disengaged therefrom in axial position two, a plurality of leaf spring members formed in the inner surface of said outer cap member to maintain said drive members in axial position two allowing said drive lugs to engage said ramp-like ratchet lugs in the tightening direction but allowing said drive lugs to readily slide over said ratchet lugs in the loosening direction means for loosely retaining said inner member within said outer member and means for removing said outer member from said inner member thereby converting said two-piece child-resistant closure to a one-piece non-child-resistant closure.

4. The closure of claim 3 wherein the means for removing said outer member comprises a vertical notch in the depending skirt of said outer member and a horizontally extending tab removably attached to the lower edge of said depending skirt.

5. The closure of claim 2 wherein said inner member also includes an outwardly extending flange integrally attached to the lower edge of said depending skirt.

6. The closure of claim 5 wherein said outer member also includes an extension removably attached to the lower edge of said outer member dependent skirt.

7. The closure of claim 6 wherein said removably attached extension is seated on said flange of said inner cap member.

8. The closure of claim 2 wherein the outer cap member skirt is seated directly on said tear strip skirt extension, said skirt extension being integrally formed as an offset extension of the inner cap member skirt.

* * * * *